United States Patent [19]

Cappa et al.

[11] Patent Number: 4,932,399

[45] Date of Patent: Jun. 12, 1990

[54] DEVICE FOR REPLACING THE FILTER OF A GAS MASK IN A POLLUTED ATMOSPHERE WITHOUT ANY CONTAMINATION RISK

[75] Inventors: Giulio Cappa, Milan; Romano Moscatelli, Rome, both of Italy

[73] Assignees: Industrie Pirelli, Milan; Ministero Della Difesa, Rome, both of Italy

[21] Appl. No.: 254,186

[22] Filed: Oct. 6, 1988

[30] Foreign Application Priority Data

Oct. 6, 1987 [IT] Italy ..... 22154 A/87

[51] Int. Cl.[5] ..... A62B 9/04

[52] U.S. Cl. ..... 128/202.27; 128/205.24; 128/206.17

[58] Field of Search ..... 128/202.27, 205.24, 128/206.15, 206.17, 912; 251/89.5, 149.9

[56] References Cited

U.S. PATENT DOCUMENTS

| | | | |
|---|---|---|---|
| 3,072,119 | 1/1963 | Matheson | 128/206.17 |
| 3,308,815 | 3/1967 | Wilcox et al. | 128/202.27 |
| 3,474,783 | 10/1969 | Ulmann | 128/206.15 |
| 3,704,002 | 11/1972 | Skarzynski | 251/149.9 |
| 3,858,910 | 1/1975 | Oetiker | 251/89.5 |
| 4,433,684 | 2/1984 | Sarnoff et al. | 128/206.17 |
| 4,453,544 | 6/1984 | Silverthorn | 128/206.15 |
| 4,559,939 | 12/1985 | Levine et al. | 128/202.27 |
| 4,793,342 | 12/1988 | Haber et al. | 128/206.17 |
| 4,831,664 | 5/1989 | Suda | 128/206.15 |
| 4,844,409 | 7/1989 | Lackler et al. | 251/149.9 |

FOREIGN PATENT DOCUMENTS

| | | |
|---|---|---|
| 958903 | 2/1957 | Fed. Rep. of Germany . |
| 3615664 | 11/1986 | Fed. Rep. of Germany . |
| 879539 | 2/1943 | France . |
| 170621 | 10/1934 | Switzerland . |

*Primary Examiner*—Edgar S. Burr
*Assistant Examiner*—Aaron J. Lewis
*Attorney, Agent, or Firm*—Stevens, Davis, Miller & Mosher

[57] ABSTRACT

A device is provided for preventing the inflow of air into a gas mask during the substitution of its filter in the presence of a contaminated atmosphere. The device includes a small plate having a central stem which passes through the support for a check valve admitting air to the respiratory tract of the user and a spring which pushes the small plate against the diaphragm of the check valve when the filter is removed from the mask to prevent inflow of air into the mask.

8 Claims, 2 Drawing Sheets

DEVICE FOR REPLACING THE FILTER OF A GAS MASK IN A POLLUTED ATMOSPHERE WITHOUT ANY CONTAMINATION RISK

FIELD OF THE INVENTION

The present invention relates to a gas mask for the protection of the respiratory tract of the user, and more particularly, it relates to a device which, in the gas mask, is able to prevent air inflow toward the user's respiratory tract when the filter is removed, allowing as a result the substitution of the filter in the presence of a contaminated atmosphere.

BACKGROUND OF THE INVENTION

As is known, a gas mask can be constituted by several parts, the primary parts being a filter and a fitting to connect it to the mask. The fitting essentially comprises a nozzle for screwing the filter and, behind the nozzle, a chamber into which is conveyed the already filtered air.

A check valve is positioned between the nozzle and the chamber; as is known, the check valve includes a diaphragm of elastomeric material, whose flexion, originated by a depression, allows air to pass from the filter to the chamber situated behind the nozzle.

It has been noted that in many cases the user of the mask must face the unforeseen event that the filter becomes exhausted, this being due to, for instance, an activity being carried out for a time longer than it was considered necessary beforehand.

In these circumstances, the user, remaining in condition of apnea and having available a new filter, might effect the various steps needed to replace the filter, namely: to remove the exhausted filter from the mask nozzle, to take a new filter from a pocket or from an appropriate container, and to screw it on the mask nozzle.

As can be readily understood, the above-indicated steps, to be carried out according to an apparently regular sequence, might be influenced, in practice, by the psychological condition of the operator, which is, of course, different for the various users, with consequent differentiated risks which might lead to a temporary interruption of the apnea, with partial inhalation of air and therefore of noxious substances highly harmful to the user's health.

Also, it is to be considered that the need of replacing an exhausted filter with a new one has a considerable importance in the event of a wide contamination in open air as, for instance, in proximity of chemical or nuclear plants in consequence of serious accidents, namely, in events where the time to reach the area of intervention from non-contaminated zones and then to return to the base is approximately the same, and sometimes longer, than the average life of a filter.

The possibility of providing a mask with a device which enables the user to remain a long time in a contaminated atmosphere, by interrupting the inflow of polluted air during the replacement of the filter, is therefore highly desirable in present masks.

Unfortunately, heretofore a satisfactory solution to this problem has not been found, since the problems to be solved are several and, inter alia, contrast with one another. In fact, one problem is that of providing and installing an additional element or device to be incorporated with the usual accessories for gas masks without however modifying the mask structure and shape already established in accordance with legal provisions currently in force.

An optimum solution, moreover, must intercept the air flow paths from the outside to the inside of the mask during the substitution of the filter without affecting the regular operation of the air flow paths when the filter is inserted in the mask nozzle.

Another problem is presented by the necessity of adding further parts to those already existing in a mask without giving rise, due to the additional weight, to conditions of intolerance or weariness for the user.

SUMMARY OF THE INVENTION

It is an object of the present invention to provide a gas mask with a device which is able to interrupt the air inflow during the substitution of the filter, allowing, therefore, this operation to be carried out in a contaminated area, and which is devoid of all of the above-cited disadvantages.

Accordingly, the invention provides a gas mask for protecting the respiratory tract of the user, which comprises a filter and a fitting to connect it to the mask, the fitting comprising a nozzle having a bottom wall which is provided with an opening communicating with a rear chamber into which flows the already filtered air. This opening is adjusted by a check valve comprising a diaphragm leaning on the inner surface of the bottom wall and sustained in its central part by a support. An annular sealing gasket, made of elastomeric material, is inserted between the filter and the bottom wall of the nozzle. The mask is characterized in that it comprises a device to interrupt the air inflow when the filter is removed. This device comprises a small plate provided with a central stem passing through the valve support in the space inside the nozzle and a spring, one end of which is associated to or retained to the bottom wall of the nozzle and the other end of which acts to push the small plate against the diaphragm of the check valve, the spring being compressed by the filter inserted in the nozzle to detach the small plate from the diaphragm.

BRIEF DESCRIPTION OF THE DRAWINGS

The present invention will be better understood from the following detailed description given only by way of nonlimiting example and made with reference to the figures of the attached sheets of drawings in which.

DETAILED DESCRIPTION OF THE INVENTION

Figure 1:
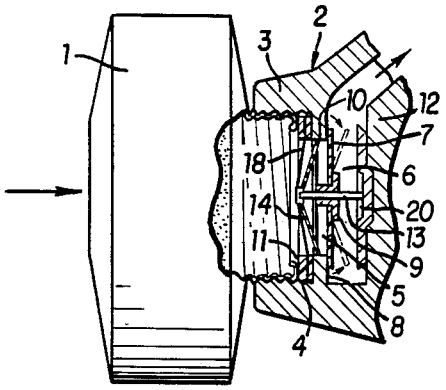
FIG. 1 shows in section a fitting for a gas mask and the corresponding filter.

The present invention will now be described with reference to a conventional gas mask of any type, comprising the peculiar accessories for protecting the respiratory tract of a user and more particularly (see FIG. 1) a filter 1, threaded at its lower portion, and a fitting 2 to connect filter 1 to the mask and to allow air inflow toward the user's respiratory tract.

Fitting 2 comprises a nozzle 3 threaded internally, having a bottom wall 4 with an opening 5 passing therethrough and communicating with a rear chamber 6 into which enters the already filtered air.

Opening 5, in order to allow air inflow or to interrupt air inflow toward the respiratory tract, is regulated by a check valve comprising a diaphragm 7, made of elastomeric material, leaning on a surface 8 of chamber 6 which coincides with the nozzle bottom wall. Diaphragm 7 is sustained in its central part by a support 9, having the shape of a bushing, which is connected by spokes (not shown) to a ring 10, which in turn is secured to the inner surface which limits opening 5.

An annular gasket 11 of elastomeric material is inserted between the lower edge of filter 1 and the bottom wall 4 of nozzle 3 in order to ensure a perfect seal between filter 1 and bottom wall 4 of nozzle 3.

The present mask comprises substantially a device able to interrupt the air inflow toward the user's respiratory tract when filter 1 is disconnected, so as to allow the introduction of a new filter in nozzle 3 even in the presence of a contaminated atmosphere.

The device comprises a small plate 12 provided with a central stem 13 passing through support 9 of the check valve in the space inside nozzle 3, and a spring 14 having one end 15 associated to or retained to a ring 10 integral with nozzle 3 and an opposite end 16 acting on stem 13 so as to push small plate 12 against diaphragm 7 of the check valve.

In the preferred embodiment shown in FIGS. 1 and 2, spring 14 is of conical type; its larger base leans on ring 10 integral with the wall containing opening 5 and its vertex is in contact with and situated below stem head 17. In this embodiment, stem 13, through spokes 18, is connected to an annular element axially displaceable inside nozzle 3.

Still preferably, the annular element comprises the aforementioned sealing gasket 11 made of elastomeric material, and in this embodiment, spokes 18 are embedded in the thickness of the elastomeric material forming gasket 11.

As can be seen in FIG. 1, filter 1, screwed inside nozzle 3, pushes inward, with its own lower circumferential edge, annular gasket 11 which, through spokes 18, pushes inward stem 13, overcoming the biasing action of conical spring 14.

Due to the stem displacement, diaphragm 7 moves away from small plate 12 and is therefore free to inflect and to allow the passage of already filtered air consequent to any action of inhalation by the user.

In all the possible embodiments deriving from the concept underlying the present invention, the stem stroke can have different values provided that, in all the selected embodiments, the stroke is sufficient to ensure the absence of any mechanical interference between small plate 12 and diaphragm 7 in condition of maximum flexion following air inhalation.

Accordingly, a feature of the invention is represented by providing a stem stroke greater than the free deflection of the radially outermost edge of diaphragm 7 subjected to depression during the user's inhalation. In particular, a preferred embodiment is that shown in FIG. 1, in which stem 13 has a stroke sufficient to bring small plate 12 in abutment against surface 19 of chamber 6, which is opposite to opening 5 communicating with nozzle 3.

Further advantageously, the surface of small plate 12 is provided with a central slot 20 which fits with the shape of central support 9 of diaphragm 7, and, correspondingly, surface 19 of chamber 6 comprises a slot 21 to receive the most protruding portion of small plate 12, avoiding therefore its occupying a part of the chamber space suitable for the free flow of the air inhaled by the user.

A further feature of the invention is represented by the provision of a spring 14, whose outward thrust is equal to or greater than the product obtained by multiplying (1) the depression of the diaphragm generated by an involuntary action of inhalation on the part of the user by (2) the diaphragm area.

For example, indicating with 500 mm $H_2O$ the depression originated by an involuntary inhalation by the user, and adopting for diaphragm 7 a diameter of 28 mm, the minimum thrust to compress the spring is only 300 grams.

This characteristic, together with the other features of the invention, allows the achievement of the above-described object of the invention.

Figure 4:
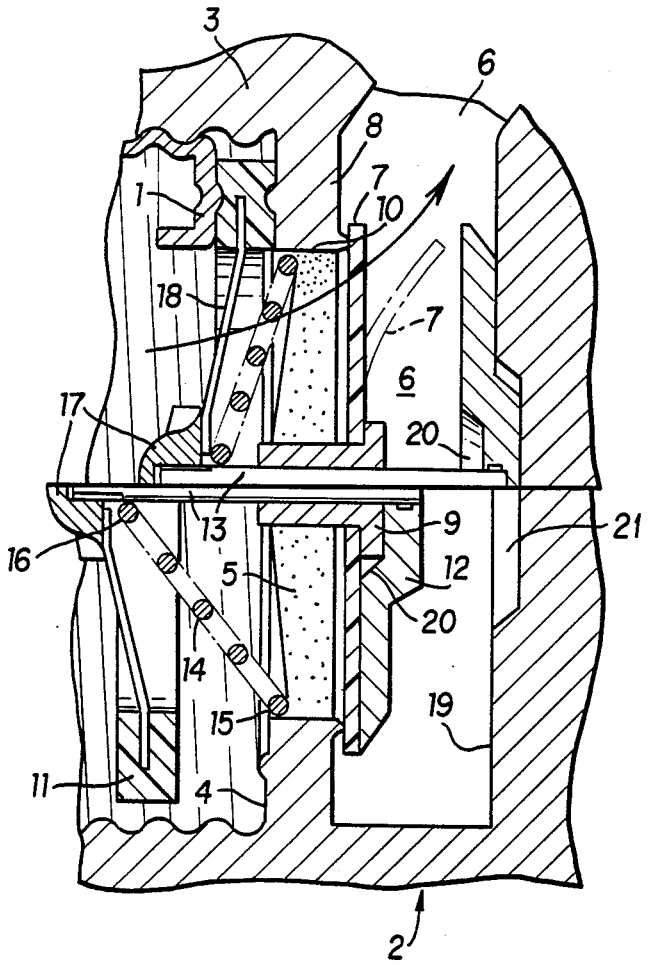
FIG. 4 shows on the top-right an enlargement of FIG. 1 and on the bottom-left an enlargement of FIG. 2.

In fact, when the filter is exhausted, it can be removed from nozzle 13 (FIG. 2 and bottom-left half of FIG. 4) without any risk to the user's health even in the presence of a contaminated atmosphere. This is because any involuntary inhalation action by the user does not allow any inflow of contaminated air toward his respiratory tract due to the thrust exerted by spring 14, with the consequent closure of the check valve by means of small plate 12.

Moreover, the presence of a device provided inside fitting 2, in addition to the elements already existing in the conventional fittings, leaves unaltered the passage of the air flow toward the respiratory tract.

Figure 3:
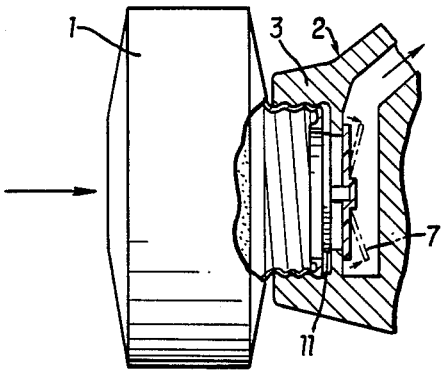
FIG. 3 shows the fitting of a conventional mask, with the filter inserted in the nozzle.

This fact will be clearly apparent from a comparison of the embodiment of FIG. 1 and the prior art shown in FIG. 3.

As can be seen in FIG. 1, the inhaled air passes into chamber 6 and flows toward the respiratory tract without encountering obstacles, essentially as in the prior art, with the only exception being a small and inconsequential dimensional thickness represented by small plate 12 abutting against surface 19 of chamber 6.

Also, it should be noted that the addition of the present device to the conventional mask elements, in the fitting of a gas mask, may advantageously be effected without the need of other stiffening arrangements or structural modifications in the shape and size of the already known fittings.

In fact, spring 14, stem 13 and small plate 12 are perfectly contained inside nozzle 3 and chamber 6, whose dimensions are practically those of the fitting according to the prior art shown in FIG. 3.

Further, the thrust of spring 14, for example 300 grams, excludes any effort or stress which may compromise the resistance of nozzle 3, which is usually sized for values of minimum tension of 50 kg. It is also evident that spring 14, by its thrust, excludes any additional effort for the user during the screwing of the filter inside nozzle 3.

Although various embodiments of the present invention have been described and illustrated, it is understood that the invention includes in its scope all possible variations deriving from the above-indicated inventive concept and principle.

Figure 2:
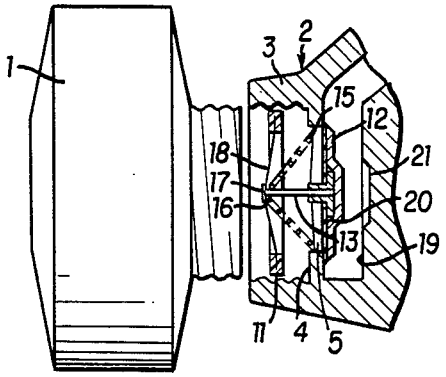
FIG. 2 shows in section the fitting of FIG. 1, with the filter removed from the nozzle.

For instance, spring 14, which in FIGS. 1 and 2 is advantageously shown in a conical shape, in order to collapse and to occupy a small shape, could alternatively be cylindrical. Also, spokes 18, protruding from the head of stem 13, could be associated with or retained to an annular element other than sealing gasket 11, as for instance a further annular element interfering with the inner surface of the end of fitting 2.

Alternatively to the above, stem 13 and spring 14 could be placed under compression by a central portion of filter 1 rather than from the lower edge of filter 1.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

We claim:

1. A gas mask for protecting the respiratory tract of a user thereof, said mask comprising:

a filter, a fitting supporting said filter and connecting it to the mask, said fitting comprising a nozzle having a wall provided with an opening communicating with a rear chamber of said fitting for receiving a flow of already filtered air, a check valve comprising a diaphragm for contacting a surface of said wall adjacent said rear chamber, said check valve for adjusting airflow through said opening, a valve support for supporting a central part of said diaphragm adjacent said opening, an annular sealing gasket of elastomeric material inserted between said filter and said wall of said nozzle, and an airflow interrupt means for interrupting air inflow through said opening when said filter is removed from said fitting, said interrupt means comprising a plate provided with a central stem passing through said valve support into a space inside the nozzle disposed on an opposite side of said wall from said side at which said diaphragm is disposed, and a spring having one end retained to said wall of said nozzle and another end disposed to push said plate against said diaphragm of said check valve when said filter is removed from said nozzle, said spring being compressed by said filter when said filter is inserted in said nozzle to move said small plate inward from said diaphragm to enable air to flow through said opening.

2. A gas mask in claim 1, wherein said spring is conical.

3. A gas mask as in claim 1 or 2, wherein an end of said stem disposed in said space inside said nozzle is connected by spokes to an annular element.

4. A gas mask as in claim 3, wherein said annular element is said gasket.

5. A gas mask as in claim 4, wherein said spokes are embedded in the elastomeric material forming said gasket.

6. A gas mask as in claim 4, wherein when said filter is inserted in said nozzle, said plate is moved to have a stroke which is greater than a deflection of an edge of said diaphragm subjected to depression when air flows into said rear chamber through said opening.

7. A gas mask as in claim 1, wherein said plate, after being moved away from said diaphragm when said filter is inserted in said nozzle, abuts against a surface of said rear chamber which is spaced apart from said opening communicating with said rear chamber.

8. A gas mask in claim 7, wherein said spring comprises means for applying a thrust on said plate which is adapted to be at least equal to a product obtained by multiplying (i) a depression generated by an involuntary inhalation by the user and (ii) a surface area of said diaphragm.

* * * * *